US005429276A

United States Patent [19]

Esclar et al.

[11] Patent Number: 5,429,276

[45] Date of Patent: Jul. 4, 1995

[54] METERING DEVICE FOR TAKING UP AND DISPENSING A VOLUME OF PRODUCT, AND METHOD FOR MIXING SEVERAL PRODUCTS IMPLEMENTING SUCH A METERING DEVICE

[75] Inventors: Dominique Esclar, Herpy L'Arlesienne; Gérard Braque, Mitry-Le-Neuf; Pierre Carmona, Gagny; Michel Gaubert, Goussainville; Franck Leitman, Tremblay En France, all of France

[73] Assignee: L'Oreal, Paris, France

[21] Appl. No.: 172,244

[22] Filed: Dec. 23, 1993

[30] Foreign Application Priority Data

Jan. 6, 1993 [FR] France ..... 93 00045

[51] Int. Cl.[6] ..... B67D 5/52

[52] U.S. Cl. ..... 222/136; 222/1; 222/144.5; 222/333; 222/387; 222/145.5; 222/181.3

[58] Field of Search ..... 222/135, 136, 137, 144.5, 222/145, 181, 320, 321, 333, 335, 387

[56] References Cited

U.S. PATENT DOCUMENTS

| | | | |
|---|---|---|---|
| 2,752,075 | 6/1956 | Hill | 222/335 X |
| 3,353,716 | 11/1967 | Fuchs, Jr. | 222/136 X |
| 3,759,425 | 9/1973 | Lee | 222/387 X |
| 4,096,972 | 6/1978 | Bartles et al. | 222/144.5 X |
| 4,312,463 | 1/1982 | Daby | 222/134 |
| 4,832,499 | 5/1989 | Fiorentini | 222/135 X |

FOREIGN PATENT DOCUMENTS

| | | | |
|---|---|---|---|
| 539989 | 8/1955 | Belgium . | |
| 0324934 | 7/1989 | European Pat. Off. . | |
| 2016999 | 10/1971 | Germany . | |
| 3629028 | 3/1988 | Germany . | |
| 63-205133 | 8/1988 | Japan . | |
| 0099231 | 4/1991 | Japan | 222/333 |

*Primary Examiner*—Andres Kashnikow
*Assistant Examiner*—Joseph A. Kaufman
*Attorney, Agent, or Firm*—Young & Thompson

[57] ABSTRACT

A metering device has a chamber of variable volume, closed at one end by a closure member; a link for the chamber with the outside, and a control for the variations in the volume of the chamber, making it possible to draw in or to discharge depending on whether the volume increases or decreases. The closure member is traversed by at least one duct emerging in the chamber and towards a container; selection elements are provided either for connecting the duct to the product container, or for closing the duct; a dispensing orifice is provided in the wall of the chamber, this orifice being equipped with a shut-off capable of being closed when drawing into the chamber and of being opened for dispensing.

15 Claims, 2 Drawing Sheets

METERING DEVICE FOR TAKING UP AND DISPENSING A VOLUME OF PRODUCT, AND METHOD FOR MIXING SEVERAL PRODUCTS IMPLEMENTING SUCH A METERING DEVICE

BACKGROUND OF THE INVENTION

1. Field of the Invention

The invention relates to a metering device for taking up, or drawing in, volume of liquid, pasty or powdered product from at least one container and then for dispensing all or part of the volume taken up, of the sort of those which comprise:

a chamber of variable volume, closed at one end by a closure member;

means for linking the chamber with the outside, and means for controlling the variations in the volume of the chamber, making it possible to draw in or to discharge depending on whether the volume increases or decreases in volume.

Such a device may serve for taking up and dispensing a single product as a metered quantity. It is, however, beneficial for it to be possible for such a device to serve, without having to be modified substantially, for sequentially taking up several different products, mixing these products, and dispensing the mixture.

2. Description of the Related Art

U.S. Pat. No. 5,078,302 relates to an appliance for taking up metered quantities of paints of different colors, coming from different containers and for mixing the metered quantities. The containers containing the paints of different colors are mounted on a turntable making it possible, in succession, to place each container from which a sample is to be taken in line with a sample-taking station. With each container is associated a pump consisting of a piston/cylinder assembly. A valve of a specific type is provided to interact with a cylinder base and, in one position, allows the liquid to be taken up or drawn in from the container and, in another position, allows the taken-up quantity of liquid to be discharged.

Such an appliance is relatively complicated, bulky, and expensive.

SUMMARY AND OBJECTS OF THE INVENTION

The object, above all, of the invention is to provide a metering device for taking up a volume of product and then for dispensing all or part of the volume taken up, of the sort defined previously, which is as simple as possible, compact, robust, and operates reliably, and which incorporates the functions of: intake/drawing in and controlled dispensing. It is furthermore desirable for such a metering device to make it possible, using additional means which are as small as possible, to incorporate the function of taking up several predetermined volumes of different products, and the function of mixing and stirring, these different volumes taken up, which then have to be dispensed.

According to the invention, a metering device for taking up a volume of liquid, pasty, or powdered product, from at least one container and then for dispensing all or part of the volume taken up, is characterized in that:

the closure member is traversed by at least one duct emerging in the chamber and towards the container;

selection means are provided which either connect the duct to the product container, or close the duct;

and a dispensing orifice is provided in the wall of the chamber, this orifice being equipped with a shutoff means capable of being closed when drawing into the chamber and capable of being opened for dispensing, the product being drawn in arrives in the chamber by passing through the duct of the closure member whereas while it is being dispensed by discharging, the above-mentioned duct is closed, whereupon the dispensing orifice opens.

Thus, according to the invention, the inlet for the product taken up into the chamber of variable volume is at a different place than the place through which the product passes for dispensing.

The chamber of variable volume may be limited by the internal wall of a cylinder and by a piston constituting the closure member, it being possible for the cylinder and the piston to have a movement of relative displacement in terms of translation in a direction parallel to the axis of the cylinder, the piston being traversed by at least one duct which is substantially parallel to the axis of the cylinder.

Advantageously, the piston is kept fixed with respect to the container while the control means ensure a reciprocating translational displacement of the cylinder along its axis, relative to the piston.

The selection means may comprise a rotary shutoff equipped with a passage hole capable of being brought in line with one end of a duct of the piston associated with the container from which it is desired to take up containing the product.

The shut-off may be placed at the internal end of the piston, this shut-off being mounted so that it can rotate about the geometric axis of the piston, it being possible to control the rotation of the shut-off from outside the cylinder.

Advantageously, the shut-off is the bottom of a cylindrical barrel in which the piston is engaged, the barrel having an axial length which is greater than that of the cylinder so that part of the shut-off it outside the cylinder when the barrel is completely driven into the cylinder, the outer part of the barrel including means for rotationally driving this barrel about the geometric axis of the cylinder, the piston having a part which remains outside the barrel.

Preferably, these drive means comprise a ring gear, the mid-plane of which is orthogonal to the axis of the barrel, this ring gear interacting with a pinion driven by an electric motor, such as a stepper motor.

Advantageously, the shut-off and the barrel are centered and fixed on the end of a rod mounted so that it can rotate in an axial bore of the piston.

Preferably, for sequentially taking up several products, the member for closing the chamber, more particularly the piston, includes several parallel ducts distributed about the axis, each duct, except one, being connected to a different liquid container, the last one of these ducts being connected to a mixing chamber. Each duct of the piston connected to a product container may be equipped, at its lower end, with a non-return valve, whereas the duct connected to the mixing chamber is not provided with such a non-return valve.

The means for shutting off the dispensing orifice itself consists of a valve preloaded to a sufficient level, advantageously to 4 newtons (400 grams force), so as to open only for a pressure which greatly exceeds that necessary for causing the product or products to pass into the mixing chamber.

The control for the translational displacement of the cylinder may be provided by an electric motor, more particularly by a stepper motor, controlling a screw, for example of the ball-type, which acts on a nut linked with the cylinder.

The device may comprise a multi-compartment container, each compartment being connected to a duct of the closure member, more particularly of the piston, all the compartments except for one being assigned to a separate product, the last one of these compartments constituting a mixing chamber, this multi-compartment receptacle being fixed directly above the outer face of the closure member or of the piston where the ducts emerge.

A thermostat with a heating element may be provided, right within the container, and may be incorporated into the system.

As a variant, the different products may be contained in containers which are separate from one another, each container being connected by a connection tube, which is as small as possible, to the end of a duct of the piston, a container, which initially is not provided with product, acting as a mixing container and also being connected to a duct of the piston.

The invention also relates to a method for mixing the various products using a device as previously defined.

According to this method, the volumes of the different products which are required for producing the mixture are taken up, or drawn in, sequentially into the chamber of variable volume, and, all these taken-up products are discharged into a mixing chamber, and, by successive reciprocating movements, the mixture is drawn in and discharged from the mixing chamber towards the chamber of variable volume, and vice versa, so as to homogenize the mixture.

BRIEF DESCRIPTION OF THE DRAWINGS

The invention consists, apart from the arrangements expounded above, of a certain number of other arrangements which will be dealt with more explicitly with regard to embodiment examples described with reference to the appended drawings, which are in no way limiting.

FIG. 5 shows, similarly to FIG. 1, the device according to the present invention along when the volume of the chamber is substantially maximum.

Finally.

DESCRIPTION OF THE PREFERRED EMBODIMENTS

Figure 1:
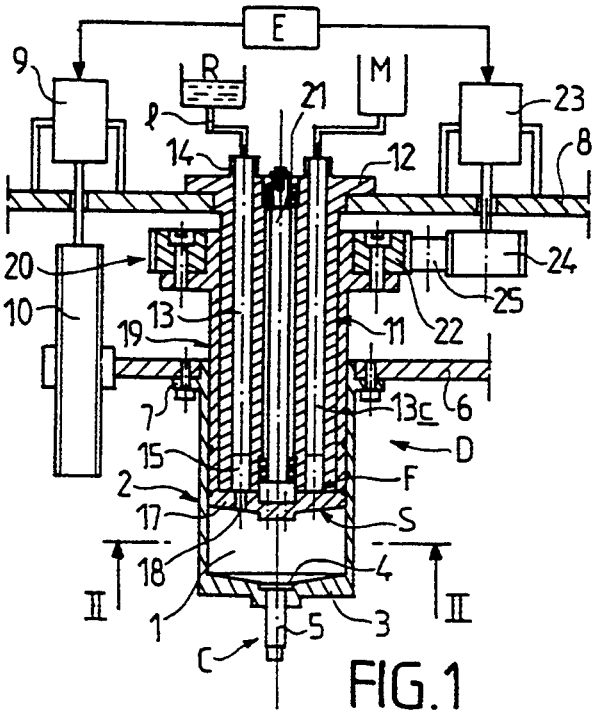
FIG. 1 is a diagrammatic and axial vertical partial sectional view of a metering device according to the invention, the variable-volume chamber having a mean volume.
Figure 2:
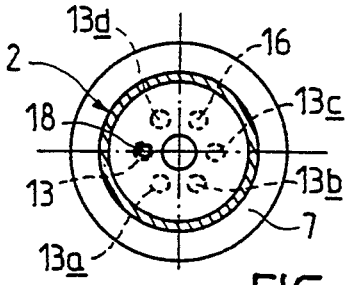
FIG. 2 is a section taken along the line II—II of FIG. 1.

Referring to the drawings, particularly to FIGS. 1 and 2, a metering device D is depicted for taking up a volume of liquid or pasty, or even powdered product, from at least one container R represented diagrammatically. By way of indication, the viscosity of the liquid or pasty products to which the invention relates may vary from 1 cp (one centipoise) to several thousands of cp (centipoises). The device D further makes it possible to dispense all or part of the volume taken up.

This device D comprises a chamber 1 of variable volume, closed at one end, namely the upper end according to the representation of FIG. 1, by a closure member F.

The chamber 1 is limited by the internal wall of a cylinder 2 which includes a bottom 3 equipped with a dispensing orifice 4 equipped with a shut-off means C capable of opening for dispensing, and advantageously consisting of a valve 5.

The cylinder 2 is fixed, towards its upper end, to a plate 6. This plate includes a hole receiving the upper edge of the cylinder 2 which includes a collar 7 traversed by holes allowing the cylinder to be fixed under the plate 6 with screws engaged in tapped holes in the said plate.

The plate 6 and the cylinder 2 may be displaced translationally in a vertical direction with respect to a supporting structure 8, only a part of which is represented.

The means for driving the plate 6 and the cylinder 2 comprise an electric motor 9, preferably a stepper motor, the stator of which is fixed to the supporting structure 8, with for example, its axis in a vertical orientation preferably. The motor 9 rotationally drives a screw 10, particularly a ball-type screw, of having a vertical axis, which interacts with a corresponding nut carried by the plate 6 to convert the rotational movement into a vertical translational movement.

The closure member F comprises a piston 11, the axial length of which is greater than that of the cylinder 2. The top part 12 of the piston 11 remains permanently outside the cylinder 2. This part 12 is fixed to the supporting structure 8. The length of the piston 11 engaged in the cylinder 2 depends on the position, in the vertical direction, of the plate 6.

The piston 11 is traversed by at least one duct 13 which at its lower end, opens out into the chamber 1 while at its upper end, the duct 13 opens out into the container, forming a collar 14. In the embodiment in question, six ducts similar to the duct 13, with axes parallel to that of the piston 11, are evenly distributed about this axis. Five of these ducts have the same function, namely to allow the chamber 1 to be connected to a different liquid container; these five ducts are denoted by the same numerical reference 13, followed by one of the letters *a–d*. Each of these ducts 13*a*–13*d* is equipped at its lower end with a non-return valve 15 allowing liquid to flow out from the duct 13 to the chamber 1 but opposing a flow in the opposite direction. The non-return valves 15 are designed, in terms of closure, to give sufficient sealing to prevent any product from flowing out under the effect of its own weight, the opening of the valve being ensured only when there is suction created by the cylinder 2 descending. By way of example, the force for closing a non-return valve 15 is chosen to be approximately 0.1N for a passage diameter of approximately 3 mm.

The sixth duct, denoted by reference numerical 16, does not have a non-return valve and is connected to a container M forming the mixing chamber.

A selection means S is provided for connecting one of the ducts 13, 13*a*–13*d*, 16 to the chamber 1, whereas the other ducts are closed by this selection means.

The selection means S comprises a rotary shut-off 17, in the form of a disc, applied against the end of the piston 11 located inside the cylinder 2. The shut-off 17 includes a passage hole 18 capable of coming in line with one end of a duct 13, 13*a*–13*d* or 16 to put this duct in communication with the chamber 1; just one duct may be placed in communication via the hole 18 with the said chamber, all the other ducts being closed by the shut-off 17. In an intermediate angular position, illustrated in FIG. 6, the hole 18 is situated between two ducts, in which case all the ducts of the piston 11 are closed by the shut-off 17.

Figure 3:
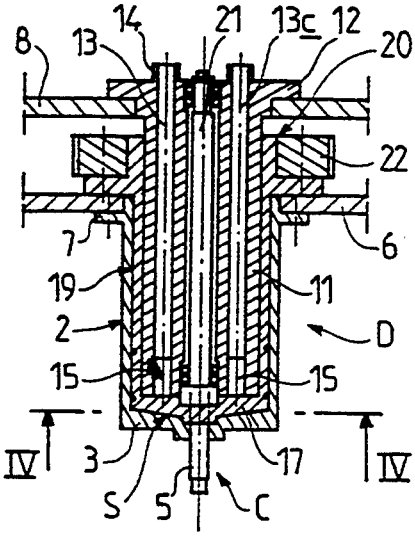

This shut-off 17 constitutes the bottom of a cylindrical barrel 19 in which the piston 11 is engaged. The barrel 19 has an axial length greater than that of the cylinder 12 so as to keep part 20, outside the cylinder 12 when the barrel is completely driven into the cylinder 2 as illustrated in FIG. 3. The axial length of the barrel 19 is, however, less than that of the piston 11.

The shut-off 17, and therefore the barrel 19, are centered and fixed on the lower end of a rod 21 which is guided in a rotary manner using ball-bearings, in the vicinity of each of these ends, in an axial bore in the piston 11. The shut-off 17 is fixed, at its central part, onto the lower end of the rod 21, for example with screws, whereas the upper end of the rod 21 is connected, in the axial direction, to the piston 11.

Means for rotationally driving the barrel 19 and the shut-off 17 about the axis of the piston 11 are provided. These drive means comprise an externally toothed ring gear 22 fixed to the barrel 19 at its upper end. The drive means further comprise an electric motor 23, preferably a stepper motor, the stator of which is fixed to the supporting structure 8; the axis of this motor 23 is preferably being vertical. The drive means drives a pinion 24 which, via an intermediate gearing system 25, can drive the ring gear 22 rotationally about the axis of the piston.

As illustrated in FIG. 1, the different ducts, such as duct 13, may be connected, at their upper end, by a conduit 1, of short length, to a liquid container belonging to each duct.

Figure 7:
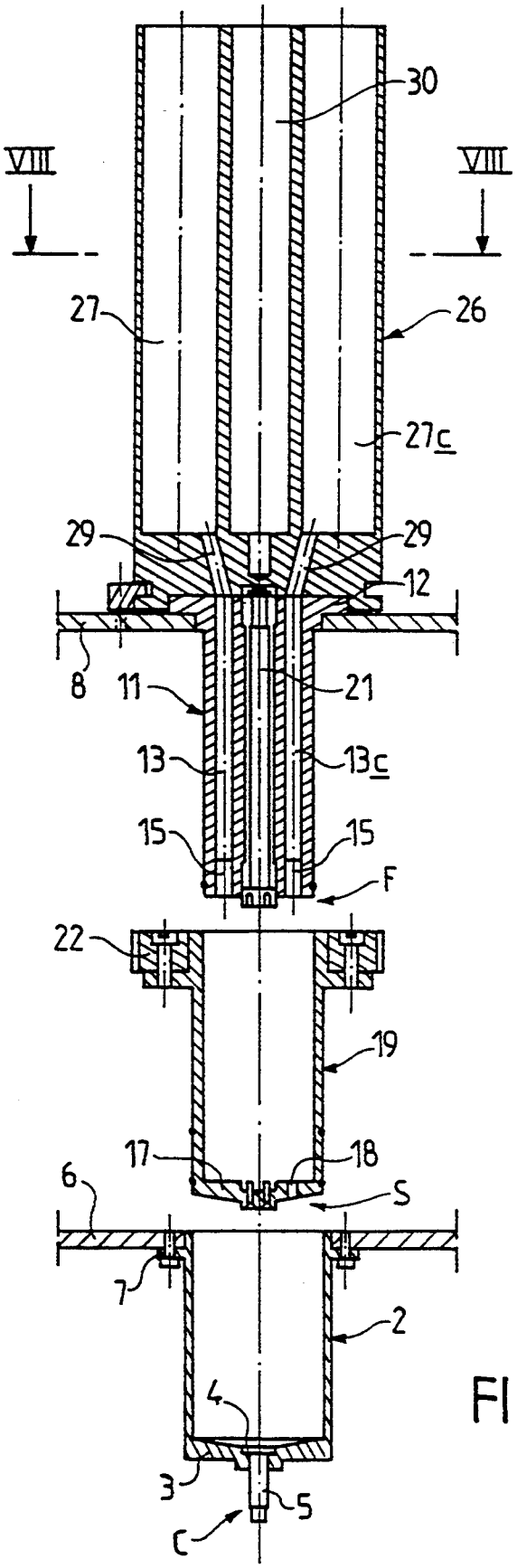
FIG. 7 is an exploded sectional view on a larger scale of the metering device according to the present invention equipped with a multi-compartment container.
Figure 8:
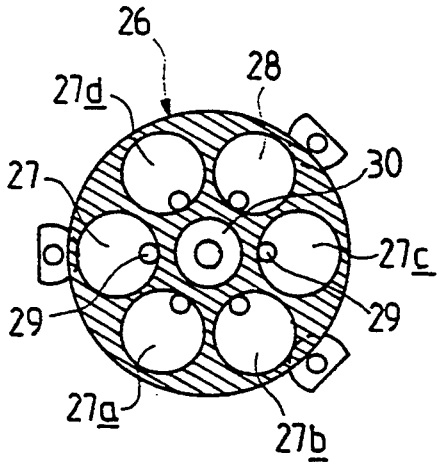
FIG. 8 is a section of the device according to the present invention along the line VIII—VIII of FIG. 7.

According to the variant illustrated in FIG. 7, a multi-compartment container is fixed to the upper part 12 of the piston. This container 26 includes as many compartments 27, 27*a*–27*d*, 28 as there are ducts in the piston 11. The container 26 consists of, for example, a cylinder inside which cylindrical chambers 27, 27*a*–27*d* and 28 are provided evenly distributed about the axis of the cylinder. The lower end of these chambers is closed by the bottom of the container which includes inclined passages 29 connecting each compartment to the upper end of the corresponding duct in the piston 11. The upper ends of the compartments 27 . . . 28 are open.

Each compartment 27, 27*a*–27*d* is intended for a different liquid product, while the compartment 28 constitutes a mixing chamber.

A central cylindrical housing 30 can receive, if appropriate, an electrical heating element for thermostatically controlling the container 26.

This above being the case, the operation of the metering device is as follows.

Consideration will first be given to the case in which the device D of FIG. 1 is used to take up and to dispense a single product.

In the rest position of the device D, illustrated in FIG. 3, the volume of the chamber 1 is zero, or practically zero, the cylinder 2 being raised to the maximum extent so that the shut-off 17 is pressed against the bottom 3, of conjugate shape, of the cylinder 2.

For the purpose of the desired take up, the barrel 19 and the shut-off 17 are made to rotate by the motor 23 controlled by instructions coming from an electronic assembly E, so as to place the orifice 18 in alignment with the duct 13 connected to the container R from which container it is desired to draw liquid.

When the angular positioning of the shut-off 17 is correct, the plate 6 and the piston 2 are made to descend by the actuation of the motor 9 in the appropriate direction. The amplitude of the stroke of the cylinder 2 is determined by the calculation assembly E to give the desired take up.

The plate 6 and the cylinder 2 are stopped when this take up has been carried out, for example when the chamber 1 occupies the mean volume represented in FIG. 1.

Figure 6:
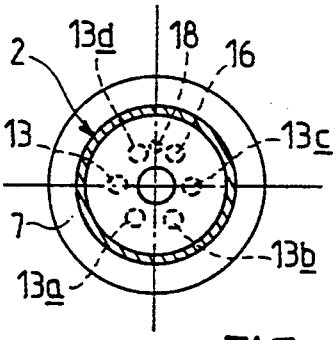
FIG. 6 is a section of the device according to the present invention along the line VI—VI of FIG. 5.

The chamber 1 is then closed by rotating the shut-off 17 so as to bring the orifice 18 between two ducts, in a position similar to the one illustrated in FIG. 6.

For dispensing the volume thus taken up, the plate 6 and the cylinder 2 are made to rise by making the motor 9 rotate in opposite direction. The pressure of the liquid contained in the chamber 1, which is totally closed, increases as soon as the cylinder 2 starts to rise, and causes the valve 5 to open and the product to be dispensed through this valve.

It should be noted that the assembly formed by the supporting structure 8 and the device D may be displaceable, with the aid of one or more electric motors and suitable guide means, in two directions X, Y which are not represented, located in a horizontal plane, so that dispensing through the valve 5 may be carried out along any desired line or surface.

This makes it possible either to deposit as a spot, or to deposit along a line or surface of any shape.

It should be noted that the dispensing of the product may be controlled by adjusting the speed at which the cylinder 2 and the plate 6 rise, this being controlled by the motor 9 and the screw 10.

In the case where it is desired to take up a metered quantity of several products, followed by mixing, and dispensing of this mixture, the operations are as follows.

A first product is pumped and metered into the chamber 1, as explained previously, but not dispensed. In other words, the cylinder 2 remains in the position which it occupies at the end of drawing in the first product, for example the position illustrated in FIG. 1.

The shut-off 17 is then rotated so as to bring the hole 18 into alignment with another duct corresponding to another product of which it is desired to take up a metered quantity. The rotation of the shutoff 17 has caused the closure of the duct which was used for the preceding take up.

The cylinder 2 is then made to descend, by the motor 9 and the screw 10, by a distance corresponding to the volume which it is desired to take up for this second product.

When this pumping/metering operation has finished on the second product, the operation described above is recommenced for a third product. Thus, all the components of the desired mixture are accurately and sequentially pumped. The maximum possible volume for the mixture taken up corresponds to the maximum volume of the chamber 1.

It should be noted that the presence of non-return valves 15 at the lower end of the take up ducts makes it possible to prevent any contamination of the products with respect to one another when the selection barrel 19 is rotated.

Figure 4:
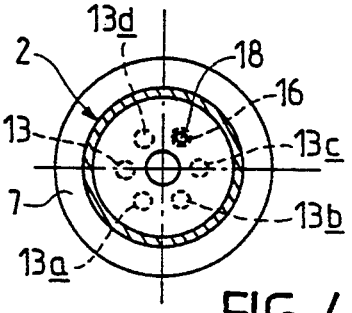
FIG. 4 is a section taken along the line IV—IV of FIG. 3.
Figure 5:
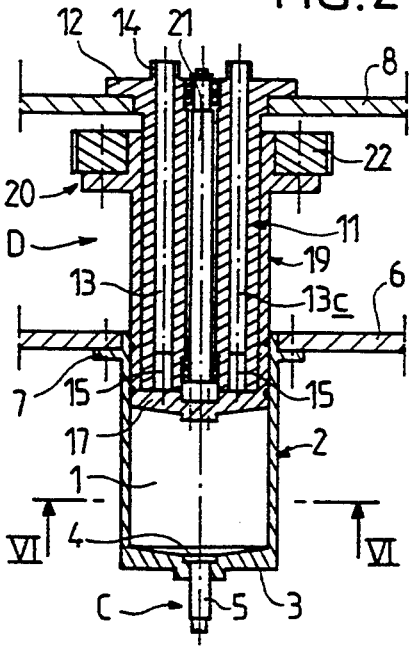
FIG. 5 shows, similarly to FIG. 1, the device according to the present invention when the volume of the chamber is at a minimum.

When the operations of pumping and metering the different components of the mixture are finished, the barrel 19 and the shut-off 17 are rotated by the motor 23 until the hole 18 is made to correspond with the duct 16 corresponding to the mixing chamber. The position of the shut-off 17 corresponds to the one illustrated in FIG. 4.

The mixing chamber, consisting of a compartment 28 in the case of FIG. 7, or of the independent container M in the case of FIG. 1, has a sufficient volume, which volume is at least equal to the maximum possible volume of the chamber 1.

The cylinder 2 is then made to rise by the motor 9 so as to discharge the mixture of products into the mixing chamber. This is possible because the valve 5 is preloaded, in the opening direction, to a value greater than the pressure necessary for causing the products to pass from the chamber 1 to the mixing chamber such as 28. By way of indication, the valve 5 is preloaded to opening at 400 grams force (4N).

The mixing chamber 28 is therefore filled with all the volume of the discharged products.

When this operation has finished, the mixture is drawn back into the chamber 1 by a descending movement of the cylinder 2; then this mixture is discharged again into the mixing chamber 28 by the cylinder 2 rising again.

These drawing in and discharging operations between the chamber 1 and the mixing chamber 28 are repeated a number of times to ensure Good homogenization of the mixture, the number of draw-ins and discharges depending on the nature of the products to be mixed.

When the mixing operation performed by sequentially drawing-in and discharging from the chamber 1 to the mixing chamber 28 is finished, the whole mixture is again drawn into the chamber 1. The barrel 19 and the shut-off 17 are made to rotate by the motor 23 until they reach an intermediate position such as the one illustrated in FIG. 6, for which the hole 18 is located between two duct orifices. The chamber 1 is then closed in a sealed manner.

The cylinder 2 is then made to rise by the motor 9 and the screw 10, which causes the mixture to be dispensed through the valve 5 which opens under the increase pressure.

The device therefore makes it possible, in addition to a volumetric metering-pumping, and controlled dispensing, to perform a homogeneous mixing of different products before dispensing them.

It is clear that it is possible to prepare a quantity of product greater than the exact quantity to be dispensed, it then being possible for the excess product to be stored via the mixing chamber 28.

All the products may be open to free air, that is to say atmospheric pressure, or may be pressurized, even under an inert gas. In the case wherein the products are pressurized in the containers, it is appropriate to set the preload of the non-return valves 15 and 5 accordingly.

As a variant, the non-return valves 15 could be eliminated in favor of an additional barrel which, by slight rotation, would serve to shut off the end orifices of the ducts such as 13 of the piston when the product is selected by the rotation of the selection barrel 19.

Also as a variant, the chamber 1, instead of being delimited by a cylinder 2 and a piston 11, could be delimited by a bellows/diaphragm assembly, the other end of which would be closed by a fixed plate, and the lower part of which could be brought towards or away from the upper plate to vary the internal volume of the bellows.

Numerous applications are possible, for example for preparing liquid mixtures, emulsions, pastes, in synthetic chemistry and, in formulating chemistry. This device may equally well be used for manufacturing liquid or pasty products, or as an instrumentation accessory, function as a tool in chemical engineering.

The device may be used for producing automata for formulating, or for personalized dispensing of cosmetic hair products, or in the pharmaceutical or foodstuff field, or for paint, makeup cosmetics, and household products.

The device may equally well be used for technical dispensing in a hairdressing salon or in hospitals.

The device of the present invention makes it possible to produce automata, particularly for formulating laboratories in general, for automatic dispensing of personalized mixtures, as well as for manufacturing activities.

Modifications of the invention herein disclosed will occur to a person skilled in the art and all such modifications are deemed to be within the scope of this invention as defined by the appended claims.

We claim:

1. Metering device for taking up a volume of at least one of a liquid product, a pasty product, and a powdered product, from at least one container, and then for dispensing a predetermined part of the volume taken up, said device comprising:

a chamber of variable volume delimited by an internal wall of a cylinder and by a piston constituting a closure member, the cylinder and the piston being movable relative to one another in a direction parallel to an axis of the cylinder, said closure member being traversed by at least one duct substantially parallel to the axis of the cylinder, said piston being fixed with respect to a supporting structure, a control means ensuring a reciprocating translational displacement of the cylinder along its axis, means for linking the chamber with the outside, the control means controlling variations in volume of the chamber to draw in and to discharge product in response to an increase and decrease in the volume of the chamber, respectively, at least one duct emerging, at one end, in a container;

selection means provided at one end of said at least one duct for connecting one of said at least one duct to the chamber, said selection means comprising a rotary shut-off equipped with a passage hole capable of being brought into alignment with said at least one duct of the piston associated with the container from which it is desired to take up a volume of product; and a dispensing orifice provided in the wall of the chamber, said orifice being equipped with a shut-off means which is closed when drawing from the chamber and open when dispensing.

2. Device according to claim 1, wherein said shut-off is placed at an internal end of the piston, said shut-off being mounted so as to allow rotation about a geometric axis of the piston, said rotation of the shut-off being controllable from outside the cylinder.

3. Device according to claim 1, wherein said shut-off is a bottom of a cylindrical barrel in which the piston is engaged, said barrel having an axial length which is greater than an axial length of the cylinder so as to keep an outer part of said barrel outside the cylinder when the barrel is completely driven into the cylinder.

4. Device according to claim 3, wherein said outer part of the barrel includes drive means for rotationally driving said barrel about a geometric axis of the cylinder, the piston having a part which remains outside the barrel.

5. Device according to claim 4, wherein said drive means comprise a ring gear the midplane of which is orthogonal to the axis of the barrel, said ring gear being capable of interacting with a pinion driven by an electric stepper motor.

6. Device according to claim 3, wherein said shut-off and said barrel are centered and fixed on an end of a rod mounted to allow rotation in an axial bore of the piston.

7. Device according to claim 1, wherein, for sequentially taking up several products, said piston includes at least two parallel ducts distributed about an axis of said piston, each one of said ducts, except a last one, being connected to a different product container, the last one being connected to a mixing chamber.

8. Device according to claim 7, wherein said ducts connected to a product container comprise a non-return valve, whereas said duct connected to the mixing chamber is not provided with such a non-return valve.

9. Device according to claim 7, wherein said shut-off means comprises a valve preloaded to a predetermined level, so as to open only for a pressure which greatly exceeds that pressure necessary for causing said at least one product to pass into said mixing chamber.

10. Device according to claim 7, wherein said device comprises a multi-compartment container, each compartment being connected to a duct of said piston, all said compartments except a last compartment being assigned to a product, said last compartment constituting a mixing chamber, said multi-compartment container being fixed directly above one of the outer faces of said closure member and the piston, where the ducts emerge.

11. Device according to claim 10, wherein said device further comprises a thermostat with a heating element within the container.

12. Device according to claim 7, wherein said products are contained in containers which are separate from one another, each container being connected by a connection tube to the end of a duct of the piston, a container, which initially is not provided with product, acting as a mixing container and also being connected to a duct of the piston.

13. Device according to claim 1, wherein said control means comprises an electric stepper motor which controls a screw which acts on a nut linked with said cylinder.

14. Method for mixing the various products, comprising the steps of:

sequentially taking up predetermined volumes of said various products into a chamber of variable volume;

discharging said taken-up products into a mixing chamber;

drawing-in said taken-up products towards said chamber of variable volume;

discharging said products from said chamber of variable volume back into said mixing chamber;

repeating said drawing-in and discharging steps until a homogeneous mixture of said taken-up products is produced.

15. Metering device for taking up a volume of at least one of a liquid product, a pasty product, and a powdered product, from a plurality of containers, and then for dispensing a predetermined part of the volume taken up, said device comprising:

a single chamber of variable volume delimited by an internal wall of a cylinder and by a piston constituting a closure member, the cylinder and the piston being movable relative to one another in a direction parallel to an axis of the cylinder, said closure member being traversed by at least one duct substantially parallel to the axis of the cylinder, means for linking the chamber with the outside, means for controlling variations in volume of the chamber to draw in and to discharge product in response to an increase and decrease in the volume of the chamber, respectively, at least one duct emerging, at one end, in one of said plurality of containers;

selection means provided at one end of said at least one duct for connecting one of said at least one duct to the chamber, said selection means comprising a rotary shut-off equipped with a passage hole capable of being brought into alignment with said at least one duct of the piston associated with the container from which it is desired to take up a volume of product; and a dispensing orifice provided in the wall of the chamber, said orifice being equipped with a shut-off means which is closed when drawing from the chamber and open when dispensing.

* * * * *